US005582912A

United States Patent [19]

McCullough, Jr. et al.

[11] Patent Number: 5,582,912

[45] Date of Patent: Dec. 10, 1996

[54] CRIMPED CARBONACEOUS FIBERS

[75] Inventors: Francis P. McCullough, Jr., Lake Jackson; Stephen E. Hill, Angleton, both of Tex.; Bhuvenesh C. Goswami, Clemson, S.C.

[73] Assignee: The Dow Chemical Company, Midland, Mich.

[21] Appl. No.: 205,224

[22] Filed: May 3, 1994

Related U.S. Application Data

[63] Continuation-in-part of Ser. No. 26,928, Mar. 5, 1993, Pat. No. 5,356,707.

[51] Int. Cl.[6] ..... B32B 9/00

[52] U.S. Cl. ..... 428/367; 428/362; 428/369; 428/408

[58] Field of Search ..... 428/362, 367, 428/369, 371, 408

[56] References Cited

U.S. PATENT DOCUMENTS

| | | | |
|---|---|---|---|
| 4,005,183 | 1/1977 | Singer | 423/447.2 |
| 4,837,076 | 6/1989 | McCullough et al. | 428/224 |
| 4,857,394 | 8/1989 | McCullough | 428/408 |
| 4,879,168 | 11/1989 | McCullough, Jr. et al. | 428/22 |
| 4,977,654 | 12/1990 | McCullough | 28/278 |
| 4,979,274 | 12/1990 | McCullough, Jr. et al. | 28/1.78 |
| 5,024,877 | 6/1991 | McCullough | 428/408 |
| 5,356,707 | 10/1994 | McCullough | 428/367 |

FOREIGN PATENT DOCUMENTS

92/07981 5/1992 WIPO .

OTHER PUBLICATIONS

Aaron D. Deutschman, Machine Design, 1975.

*Primary Examiner*—N. Edwards

[57] ABSTRACT

The present invention resides in ignition resistant non-linear carbonaceous fiber or fiber tow having a reversible deflection ratio of greater than 1:1 but equal to or less than 1.2:1. The fibers have a multiplicity of crimps along their length with a crimp frequency on the order of from 6 to 15 crimps per inch. Fibers of the invention have an elongatability of from about 2 to about 9%, a pseudo-elongatability of from about 0.2 to about 18%, and a tenacity without a loss of elongation on the order of at least 6 g/d. The carbonaceous fibers can be used, for example, as thermal insulation and/or fire resistant insulation in vehicles, building structures or clothing in furniture coverings, carpets, and the like, and can be used alone or blended with other fibers to form fine yarns.

10 Claims, 4 Drawing Sheets

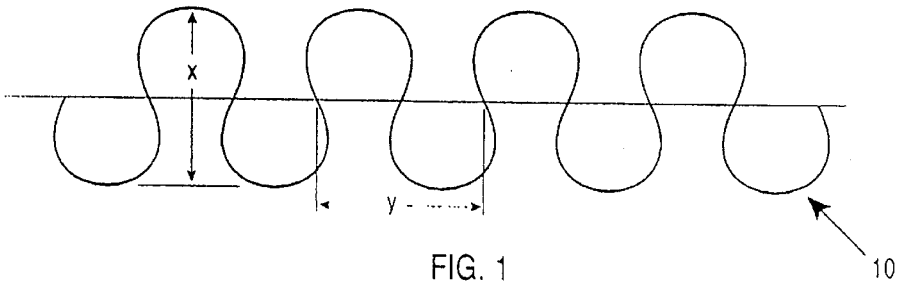
FIG. 1
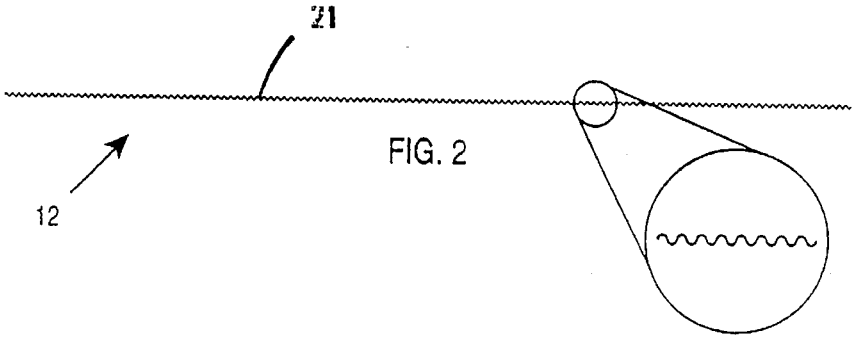
FIG. 2
FIG. 2a
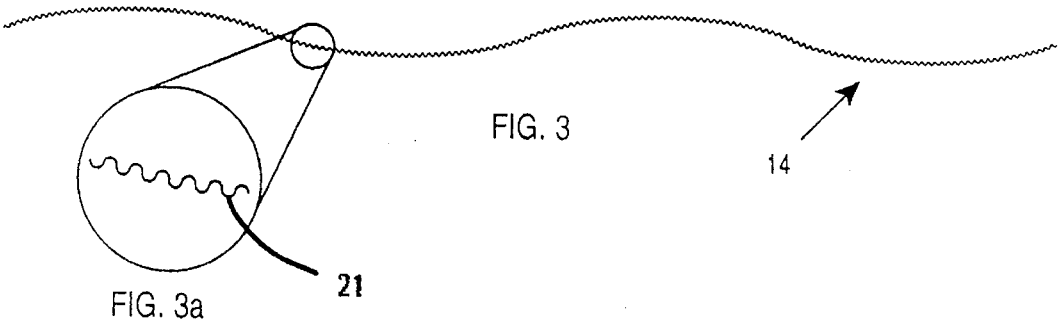
FIG. 3
FIG. 3a

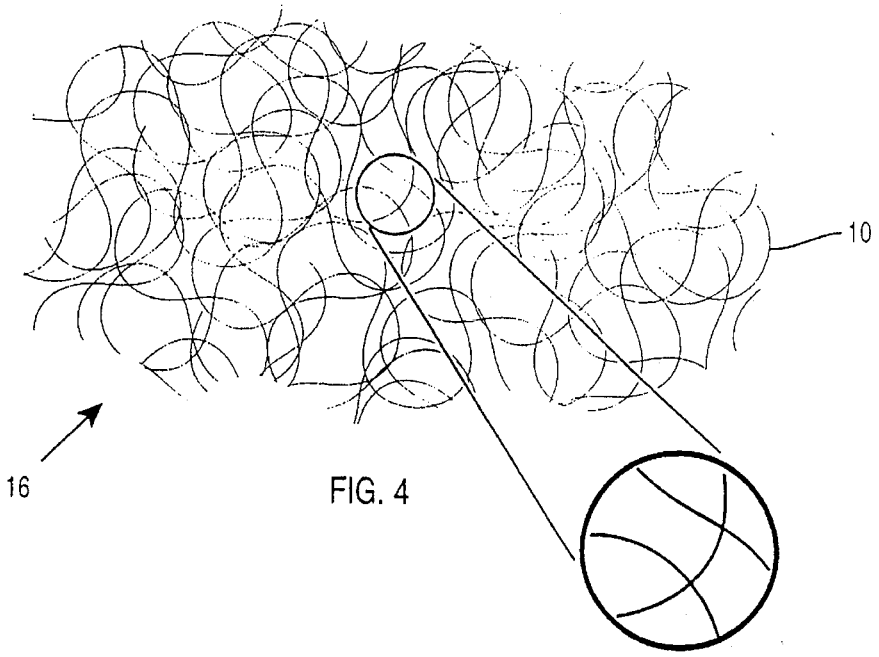
FIG. 4
FIG. 4a
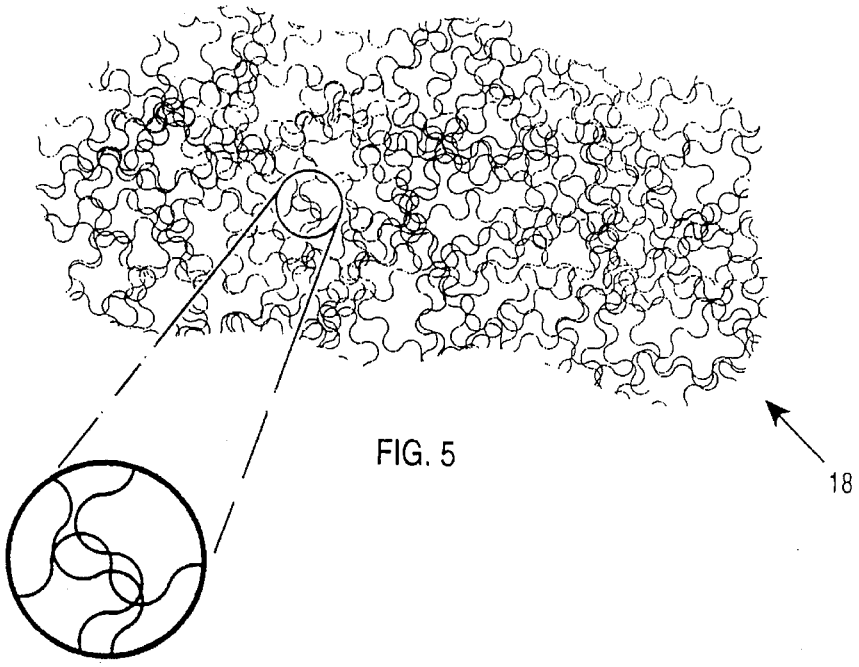
FIG. 5
FIG. 5a

CRIMPED CARBONACEOUS FIBERS

RELATED APPLICATIONS

The application is a continuation-in-part of application Ser. No. 08/026,928 filed Mar. 5, 1993 entitled "Crimped Carbonaceous Fibers" of McCullough et al. now U.S. Pat. No. 5,356,707.

FIELD OF THE INVENTION

The present invention relates to a novel fire resistant carbonaceous fiber or fiber assembly having improved processability and to fibrous materials made therefrom. More particularly, the invention resides in a fire resistant fiber or fiber assembly having a multiplicity of crimps with a reversible deflection ratio of greater than 1:1 but equal to or less than 1.2:1. The carbonaceous fiber of the invention has improved physical characteristics with a pseudoelongatability of from about 0.2 to about 18%, an elongatability to break of from at least about 2 to about 9%, and a tenacity of about 2 g/dn and up to 20 g/dn, preferably from about 5 to 13 g/dn.

BACKGROUND OF THE INVENTION

The manufacture of nonlinear carbonaceous fibers having a reversible deflection ratio of greater than 1.2:1 and derived from a polymeric precursor composition, such as polyacrylonitrile (PAN), is known and disclosed in U.S. Pat. No. 4,837,076 to McCullough et al. In the prior patent, the polymeric precursor material is spun into fibers and collected into multifiber assemblies, such as fiber tows, containing more than 1000 (1 K) individual fibers, but generally not more than 12,000 to 20,000 fibers. The fiber tows are thereafter oxidatively stabilized and formed into a knitted fabric which is then heat treated in a non-oxidizing atmosphere while the fibers are in a relaxed and unstressed condition. Heat treating the fibers increases the carbon content to form carbonaceous fibers which are substantially heat set. The fabric is then deknitted to form non-linear fiber tows in which the individual fibers are characterized by having a reversible deflection ratio of greater than 1.2:1, typically from about 2.5:1 to about 4:1. The fiber tows can then be further processed, as by carding, to form a wool like fluff.

These prior non-linear carbonaceous fibers, although they exhibit substantial advantages in processability over other carbonaceous fibers, still suffer from the disadvantage of having to be knitted from a relatively small tow of fibers of from about 1000 individual fibers (1 K) to about 12000 fibers (12 K) and then having to be deknitted.

Firstly, knitting of the fiber tows and the subsequent deknitting procedure is costly in terms of the equipment that must be used to process the fibers into a wool like fluff and the time that is consumed in knitting/deknitting and subsequent chopping and opening of the fibers to form a wool like fluff.

Secondly, present day knitting machines are not able to accommodate fiber tows that are much larger than 20,000 fibers. Thus, the use of relatively small fiber tows is in itself a limiting factor when it is desired to produce large amounts of the wool like fluff. Another disadvantage of knitting fiber tows is dictated by the fact that the knitting hooks of a knitting machine are not able to engage tows that are larger than 20,000 fibers. The knitting hooks are not large enough to engage the entire tow in its formation of a loop thereby leaving some portion of the fibers of the tow outside of the hook which inevitably leads to a severe entanglement of the fibers during the knitting opperation and eventually to a complete breakdown of the operation.

A further disadvantage of knitting relatively small fiber tows (of less than 20 K) is that the tow of fibers is still so large in diameter that it is not possible to provide the fibers with a fine crimp, as herein after defined, due to the large loops that are formed in knitting a cloth. Specifically, with a 12 K tow, the individual fibers have a relatively large amplitude and a relatively low frequency so that, in effect, the fibers have a reversible deflection ratio of greater than 1.2:1. Accordingly, it is not possible to use the knit/deknit process to produce fibers having a greater number of crimps per inch i.e. on the order of greater than 4 crimps per inch (2 crimps per cm) to provide the fibers with a reversible deflection ratio of less than 1.2:1.

Another drawback of the non-linear carbonaceous fibers of the prior art is that it has not been possible to spin these carbonaceous into fine yarn with acceptable staple length especially when they are blended with other synthetic or natural fibers due to the nature of their crimps. Although the crimps in the fiber are necessary for good processability, the relatively large amplitude and low frequency of the crimps causes excessive fiber breakage during carding and drawing. In addition, the prior art fibers exhibit a fairly low cohesiveness and compromise elongatability to improve tenacity.

As a result of the relatively low cohesiveness of the fibers with a reversible deflection ratio of greater than 1.2:1, any yarn which is produced therewith has a greater bulkiness and is difficult to process into garments without the use of special techniques or apparatus.

SUMMARY OF THE INVENTION

According to one embodiment, the present invention resides in a non-linear, fire resistant, carbonaceous fiber or tow of fibers having a reversible deflection ratio that is greater than 1:1 but equal to or less than 1.2:1.

The present invention further provides for a carbonaceous fiber having a tenacity of from about 2 to 20 g/dn, preferably from about 5 to 13 g/dn.

The present invention further provides for a carbonaceous fiber having a complex or dual crimp for improved loft and cohesiveness in fibrous structures such as yarn, battings, etc., the complex on dual crimp comprises a combination of a low frequency/high amplitude crimp and a high frequency/low amplitude crimp.

The present invention also resides in a method of making a non-linear carbonaceous fiber having a reversible deflection ratio that is greater than 1:1 but equal to or less than 1.2:1 especially from a tow having more than 40,000 individual fibers in the tow.

The present invention also resides in a method in which the polymeric precursor fibers are treated to a dynamic flow of an inert gas that is directed against the fibers during the heat treatment step. Non-linear carbonaceous fibers can now be produced which exhibit a greater tenacity and elongation to break.

The present invention includes blends of the improved carbonaceous fiber with other natural or synthetic fibers, including blends for the manufacture of fine yarns.

The present invention further incorporates the improved carbonaceous fibers into thermal insulation, ignition resistant and/or fire blocking structures.

The invention also includes the use of the carbonaceous fibers of the invention in the manufacture of improved fiber structures that are lightweight, resilient, and compressible. These fiber structures have good shape and volume retention and are stable to numerous compression and unloading cycles without breakage of the fibers.

The invention further resides in a yarn of the carbonaceous fibers of the invention alone or in combination with natural or synthetic fibers. The yarn comprises at least 7.5% by weight of the non-linear carbonaceous fibers of the invention so as to provide ignition resistance to the yarn.

It is therefore an object of the present invention to prepare a carbonaceous fiber having good cohesive properties and good processability.

It is a further object of the invention to prepare a carbonaceous fiber which can be spun into a fine yarn.

It is a still further object of the invention to prepare a carbonaceous fiber having improved fire blocking properties and to fire blocking structures.

These and other objects and advantages will be better understood from the following detailed description of the invention and drawings.

DEFINITIONS

The term "reversible deflection ratio" as used herein generally applies to a helical or sinusoidal compression spring. Particular reference is made to the publication, "Mechanical Design—Theory and Practice", MacMillan Publ. Co., 1975, pp. 719 to 748: particularly Section 14-2, pp. 721 to 724. More particularly, the reversible deflection ratio is the ratio of the length of a section of a fiber or tow of fibers when in a fully extended condition and when under a load just less than the breaking load, to the length of a section of a fiber or tow of fibers when under no load and when in a fully relaxed non-linear configuration.

The term "stabilized" used herein applies to precursor fibers or fiber tows that have been oxidized at a temperature of typically less than 300° C. for acrylic fibers prior to subjecting the fibers to a heat treatment to convert the precursor fibers to carbonaceous fibers. It will be understood that, in some instances, the fibers or fiber tow can also be oxidized by chemical oxidants at a lower temperature.

The term "permanent" or "irreversibly heat set" used herein applies to non-linear fibers which have been heat treated under the conditions as set forth hereinafter until they possess a degree of resiliency and flexibility such that the fibers, when stretched and placed under tension to a substantially linear shape, but without exceeding the tensile strength of the fibers, will revert substantially to their original non-linear shape once the tension on the fibers is released. The foregoing terms also imply that the fibers are capable of being stretched and released over many cycles without breaking the fibers.

The term "fiber structures" used herein applies to a yarn, multiple strands of fibers in the form of a tow, or a multiplicity of randomly entangled fibers that are in the form of a wool like fluff, web, batt, felt, tape, sheet, or the like, depending upon the desired loft and density of the structure, a knitted or woven cloth or fabric, or the like. The fibrous structure can also be in the form of a single ply or a multiplicity of superimposed or stacked plies of fibers.

The term "Crimp" as used herein refers to the waviness or non-linearity of the fiber or fiber tow, as defined in "Man Made Fiber and Textile Dictionary" by Celanese Corporation. The term crimp includes different nonlinear configurations such as, for example, sinusoidal, coil like, and the like. The term "crimp" includes a complex crimp comprising a combination of two or more geometric or nongeometric configurations where, for example, one crimp is superimposed upon another crimp. For example, a complex crimp can be one in which a crimp having a relatively low frequency with a high amplitude is superimposed upon a crimp having a relatively high frequency and a low amplitude, or vice versa.

The term "fine crimp" relates to fibers having a crimp frequency of from about 6 to 15 crimps per inch (236 to 590 crimps/m) and an amplitude of typically about 0.5 mm.

The terms "Elongatability" and "Elongation to break" refers to the stretching of the fiber in a linear state without exceeding its breaking point.

The term "Pseudoelongatability" refers to the elongatability of a non-linear fiber which results from i.e. the crimp, including complex crimp, or false twist that may be imposed on the fiber. The percent pseudoelongatability is derived by placing the fiber into a linear state under stress but in which the fiber still exhibits a residual non-linear configuration and/or false twist.

The term "bending strain" of the fiber as used herein is as defined in Physical Properties of Textile Fibers by W. E. Morton and J. W. S. Hearle, The Textile Institute, Manchester, 1975, pages 407–409. The percent bending strain on a fiber is determined by the equation:

$$S=(r/R)\times 100$$

where S is the percent (%) bending strain, r is the fiber radius, and R is the radius of curvature of bend in terms of the crimp. That is, if the neutral plane remains in the center of the fiber, the maximum percentage tensile strain, which will be positive on the outside and negative on the inside of the bend, equals $(r/R)\times 100$ in a circular cross-section of the fiber.

The term "carbonaceous fiber" is understood to mean that the carbon content of the polymeric precursor fiber has been increased to greater than 65% by weight as a result of an irreversible chemical reaction (condensation) of the polymer during heat treatment in a nonoxidizing atmosphere. Fibers having a carbon content of greater than 92% are generally defined as carbon fibers, while fibers having a carbon content of greater than 98% are generally referred to as graphitic fibers.

The term "cohesion" or "cohesiveness" refers to the force which holds fibers together during yarn manufacture or other textile processing. It is a function of the type of crimp used on the fiber. For example, a fiber having fine crimps, i.e. high frequency and low amplitude, has greater cohesion than a fiber with large crimps, i.e. low frequency and high amplitude.

The term "reloft" defines the ability of a fibrous material such as a batting to return to its original dimension after the material has been subjected to a compression load of 15 psi (104 kPa) for one hour at ambient temperature.

All percentages set forth herein are in weight percent.

BRIEF DESCRIPTION OF THE DRAWINGS

FIG. 1 is a schematic illustration of a crimped carbonaceous fiber that is known in the art having a reversible deflection ratio of greater than 1.2:1. The crimps in the fiber are shown at an enlarged scale;

FIG. 2 is a schematic illustration, at an enlarged scale, of a carbonaceous fiber which is representative of the invention in showing a fine crimp, i.e. a substantial increase in the frequency of the crimps and decrease in amplitude, as compared to the fiber of FIG. 1, to form a non-linear fiber of the invention with a reversible deflection ratio of greater than 1:1 but equal to or less than 1.2:1;

FIG. 2A is a schematic illustration, at an enlarged scale, of a portion of the fine crimp fiber of FIG. 2.

FIG. 3 is a schematic illustration of the fiber of FIG. 2 which has been provided with an overcrimp, i.e. a complex crimp to provide an overall sinusoidal configuration to the fine crimped fiber;

FIG. 3A is a schematic illustration, at an enlarged scale, of a portion of the fiber of FIG. 3.

FIG. 4 is a schematic illustration, at an enlarged scale, of a multiplicity of the crimped carbonaceous fibers of FIG. 1 in the form of a wool like fluff.

FIG. 4A is a schematic illustration, at an enlarged scale, of a portion of the wool like fluff of FIG. 4, illustrating a plurality of intersecting fibers.

FIG. 5 is a schematic illustration, at an enlarged scale, of a multiplicity of the crimped carbonaceous fiber of FIG. 2 or 3, forming a wool like fluff.

FIG. 5A is a schematic illustration, at an enlarged scale, of a portion of the wool like fluff of FIG. 5, illustrating a plurality of intersecting and interlocking fibers.

DESCRIPTION OF THE PRIOR ART

Figure 6:
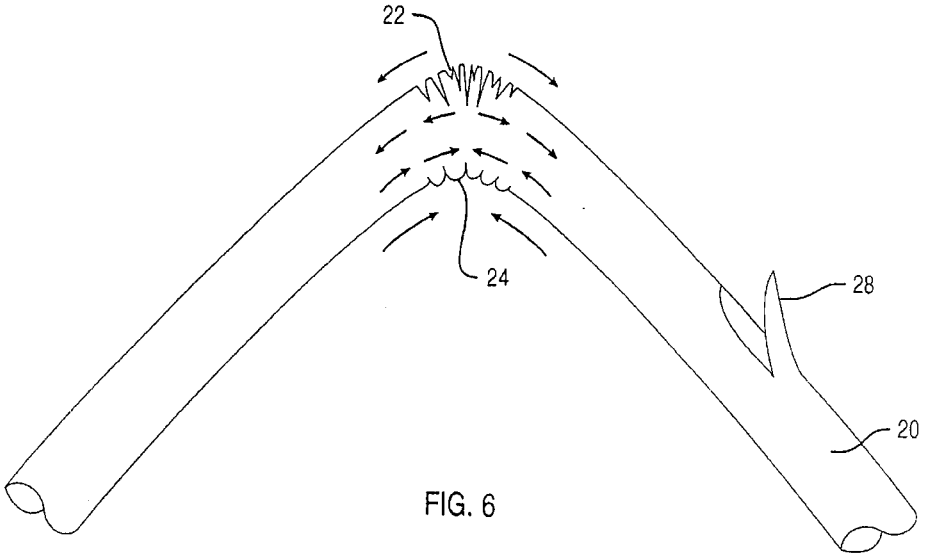
FIG. 6 is a schematic illustration, at an enlarged scale, of a fiber having a sharp angular bend with a bending strain value of greater than 50% and with stress ridges or cracks on the outer portion and compression ridges at the inner portion of the angular fiber bend.

Stuffer box crimping and traditional gear crimping, which is commonly used in fiber processing, results in the formation of sharp V-type bends in the fiber wherein the outer portion of the fiber bend is subject to severe stress and the underside of the bend is subject to severe compression. These sharp bends therefore result in severely weakened portions in the fiber 20, such as cracks or fissures 22*a* on the outer fiber portion, and compression ridges 24*a* on the inner fiber portion, as illustrated in FIG. 6.

In addition, traditional gear crimping results in mashing of the fibers between the gears, resulting in compressed and flattened fiber portions. The sharp edges of the intermeshing gears also cause damage to the fibers such as gouging or fibrillation. Accordingly, any defective portions in the polymeric precursor fibers are enhanced when the fiber is heat treated in an inert atmosphere to increase the carbon content of the fibers, this process also resulting in shrinkage of the fiber material. The damaged carbonaceous fibers, when subsequently subjected to a bending strain of greater than 50%, will lead to breakage of the fibers at their defective portions, especially with fibers that exhibit a greater rigidity or stiffness such as will occur in fibers that are heat treated at a higher temperature resulting in a higher carbon content.

In an article by Hall et al entitled, "Effects of Excessive Crimp on the Textile Strength and Compressive Properties of Polyester Fibers," in Journal of Applied Polymer Science, Vol. 15. pp. 1539–2544 (1971), the authors describe the detrimental effects of forming sharp crimps in polyester fibers as well as other man made fibers. The authors report that excessive crimping, such as is found in V-type crimps, leads to surface damage of the fiber and a reduction in tenacity and other physical properties, e.g. elongatability which leads to fiber breakage when the fiber is placed under tension.

U.S. Pat. Nos. 4,979,274 and 4,977,654 to McCullough et al disclose apparatuses for crimping and permanently heat setting fibers without placing stress or strain on the fibers. However, the apparatuses do not produce fine crimped carbonaceous fibers having a reversible deflection ratio that is greater than 1:1 and equal to or less than 1.2:1. These fibers have substantially no cohesiveness and are difficult to process into yarn since the yarn formed thereby is bulky and difficult to process into garments.

As illustrated in FIG. 1 there is shown a non-linear carbonaceous fiber 10 having crimps which is prepared according to the process described in U.S. Pat. No. 4,837,076. The amplitude (x) of the fiber is determined from a reading along a vertical axis, while the frequency (y) of the fiber is determined by a reading along a horizontal axis. Although the frequency of the fiber is greatly exaggerated in FIG. 1, it graphically illustrates a fiber having a relatively large or low frequency (y) and a corresponding relatively large reversible deflection ratio of greater than 1.2:1. Although such a fiber is entirely suitable for making bulky yarns, it can not be used in the manufacture of fine yarns that are used in many other fiber structures such as fabrics, and the like. The low frequency of the crimps makes the fiber difficult to process, especially when the fiber is blended with other fibers, thus resulting in a poor cohesiveness of the blended fibers. Therefore, the application of these low frequency fibers cannot be extended for use in textiles which call for fine yarns.

DESCRIPTION OF THE PREFERRED EMBODIMENTS

Illustrated in FIGS. 2 and 2A is a fiber 12 of the invention which, in comparison with the prior art fiber 10, is provided with a greater number of crimps along the length having a frequency of from about 6 to 15 crimps per inch (236 to 590 crimps per met.), preferably from 9 to 12 crimps per inch (354 to 472 crimps per met.). A comparatively higher crimp frequency has the effect of increasing the cohesiveness and interengagement between the individual fibers and aids in reducing fiber breakage during processing. In addition, there is an improved cohesiveness between the carbonaceous fibers with a relatively higher crimp frequency when blended with other fibers or when formed into a yarn with similar fibers. Fibers having a relatively high frequency have a corresponding relatively low reversible deflection ratio, namely one which is greater than 1:1 but equal to or less than 1.2:1.

FIGS. 3 and 3A illustrate another embodiment of the invention in which the fiber 14 is provided with a complex or dual crimp in which a crimp of a relatively low frequency is imposed upon a fiber having a crimp of a relatively high frequency. For example, a fiber or fiber tow can be provided with a first crimp having a frequency of 15 crimps per inch. The same crimped fiber is then subjected to a second crimping operation in which a second crimp having a frequency of, for example, 2 to 6 crimps per inch, is superimposed on the fiber 14. It will be apparent that the fiber or fiber tow can also be provided with a crimp of a relatively low frequency, followed by a crimp having a relatively high frequency.

As illustrated in FIGS. 4 and 4A, there is shown a substantially magnified view of a wool like fluff 16 consisting of a multiplicity of carbonaceous fibers 10 having crimps as shown in FIG. 1 as prepared according to the process described in U.S. Pat. No. 4,837,076. From a further enlargement of a portion of the wool like fluff, illustrated in FIG. 4A, it can be seen that the intersecting fibers have substantial freedom to move relative to each other and are not in any way interlocked with each other, except where the fibers are in abutment with each other. Accordingly, the wool like fluff 16 made from these fibers 10 has good loft but relatively little cohesion. These fibers do not lend themselves well in the manufacture of fine yarn or fabrics, although the wool like fluff 16 is entirely suitable for the manufacture of battings, and the like.

As illustrated in FIGS. 5 and 5A, there is shown a substantially magnified view of a wool like fluff 18 of a multiplicity of the carbonaceous fibers 12 having the fine crimps as prepared in accordance with the present invention. From the further enlargement illustrated in FIG. 5A, it can be seen that the fibers, due to their higher frequency and lower amplitude, are much more likely to interengage and interlock with each other. Accordingly, the wool like fluff 18 made from these fibers 12 has greater cohesion and the fibers 12 lend themselves much more readily to the manufacture of fine yarns or fabrics. If the fibers are provided with a dual crimp as shown in FIG. 3 and assembled into a wool like fluff, the fluff will exhibit the characteristics of each crimp component, i.e. the low frequency/high amplitude portion of the fibers will provide the wool like fluff with the desired loft, while the high frequency/low amplitude portion of the fibers will provide the wool like fluff with the improved cohesion between the fibers as well as greater stability of the fibrous material.

Preferably, the carbonaceous fiber of the invention has a reversible deflection ratio of greater than 1:1 but equal to or less than 1.2:1, an elongatability of from at least about 2 to about 9%, a pseudoelongatability of from about 0.2 to about 18%, preferably from about 2 to about 10%, and a bending strain value of less than 50%, preferably less than 30%. Carbonaceous fibers of the invention derived from a polyacrylonitrile (PAN) precursor fibers have a tenacity of at least 2 g/d., preferably from about 5 to about 13 g/dn and up to as high as about 20 g/dn, an elongatability of from about 3.5 to about 4.5%, and a pseudoelongatability of from about 0.2 to about 18%.

In contrast, a polyacrylonitrile based carbonaceous fiber 10 formed according to the prior art process that has been heat treated for 1.5 minutes at a temperature of about 650° C. has a tenacity of from about 4 to about 5 g/d and an elongation to break of from about 2 to about 3%.

The carbonaceous fibers of the invention are nonflammable and ignition resistant and, when blended with other fibers in an amount of as little as about 7.5%, also provide an improved ignition resistance for the blend or structure employing the blend.

For processability, a fiber with at least 6 to 15 crimps per inch provides the fiber with flexibility at stress points so as to avoid fiber breakage and greatly improves the frictional forces between the fibers as well as fiber to fiber cohesion. The relatively higher frequency of crimps is an important factor in good fiber cohesiveness when forming yarns.

Figure 8:
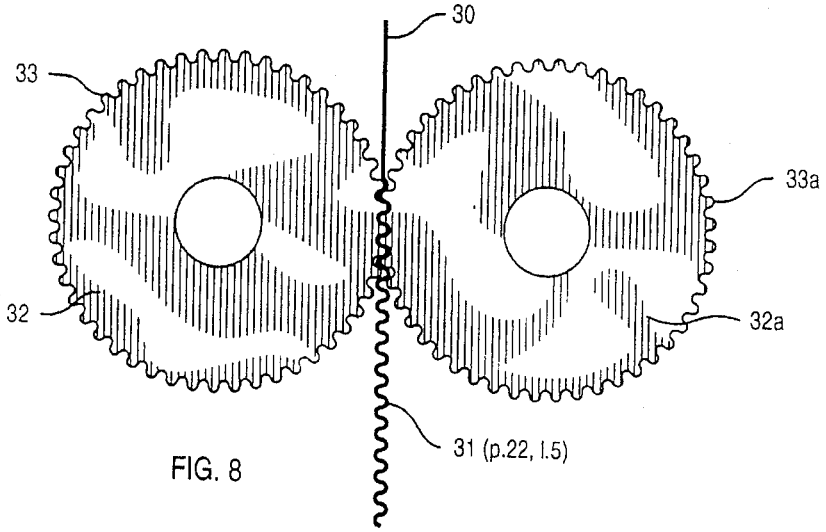
FIG. 8 is a schematic illustration of a crimp forming sprocket wheel mechanism which can be used to prepare the fibers of the invention.

FIG. 8 illustrates a method of providing a fiber tow 30 with a multiplicity of crimps 21 prior to substantially permanently heat setting the crimps by a subsequent heat treatment which increases the carbon content of the fiber tow. As shown, the tow 30 passes between a pair of noncontacting gears 32,32*a* which preferably have rounded teeth or elongated rounded ribs 33,33*a*. The gears are spaced from each other by a distance sufficient to allow the fiber tow to enter the spaces between the teeth or ribs without the application of a tensile or compression force on the fibers in the tow, thereby avoiding the formation of sharp V-shaped crimps, fibrillation, or other extrusion or compression damage as shown in FIG. 6 that result in an undesirably high bending strain or outright breakage of the fiber.

Figure 7:
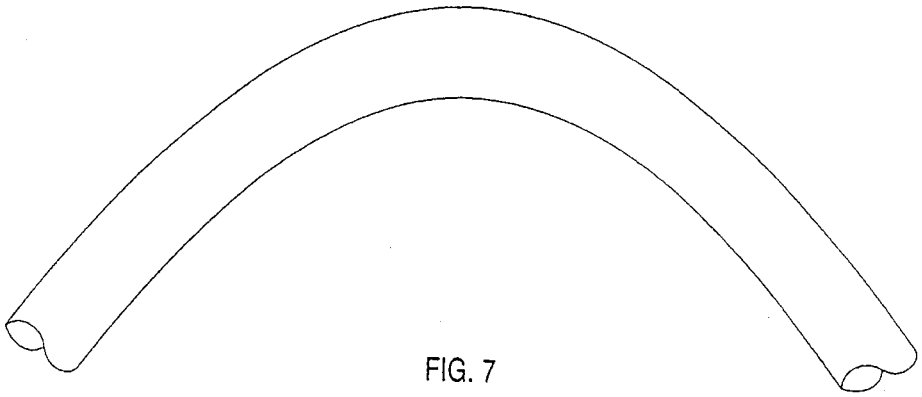
FIG. 7 is an enlarged schematic illustration of a fiber of the invention in which the bending strain value of the fiber is less than 50%.

Advantageously, as shown in FIG. 7 the crimped portion of the fiber does not have more than a 15% variation from the fiber diameter prior to crimping, preferably not more than 5%. Under carefully controlled conditions the crimped portion is substantially free of any measurable variations in diameter.

One method of forming the crimped fibers of the present invention is to utilize a constant indexing crimp forming device which does not apply a bending strain on the fibers of more than 50%. As shown in FIG. 8, the crimp forming device comprises a pair of floating, noncontacting wheels 32,32*a* which form the crimp as the teeth or ribs 33,33*a* engage the fiber or fiber tow 30. In addition, an antibacklash assembly (not shown) is provided which drives each of the wheels 32,32*a* in constant synchronization and transfers the torque from the teeth 33 of one wheel 32 through the fibers to the teeth 33*a* of the other wheel 32*a* while compensating for any variable spacing between the wheels 32,32*a*. Accordingly, a crimp 31 is formed without damaging the fibers and without the formation of sharp V-shaped crimps in the fibers since the teeth 33,33*a* do not come into contact with each other and do not apply any damaging stress, compression or other shape distortion on the fiber or fiber tow, regardless of the size of the fiber tow employed. The fibers are then heat treated so as to form the carbonaceous fibers of the invention and to substantially permanently heat set the crimps as disclosed in U.S. Pat. No. 4,837,076.

The crimping wheels 32,32*a* can be heated to impart a temporary heat set to the polymeric precursor fibers in the tow sufficient to hold the crimps prior to heat treatment of the crimped tow.

Figure 9:
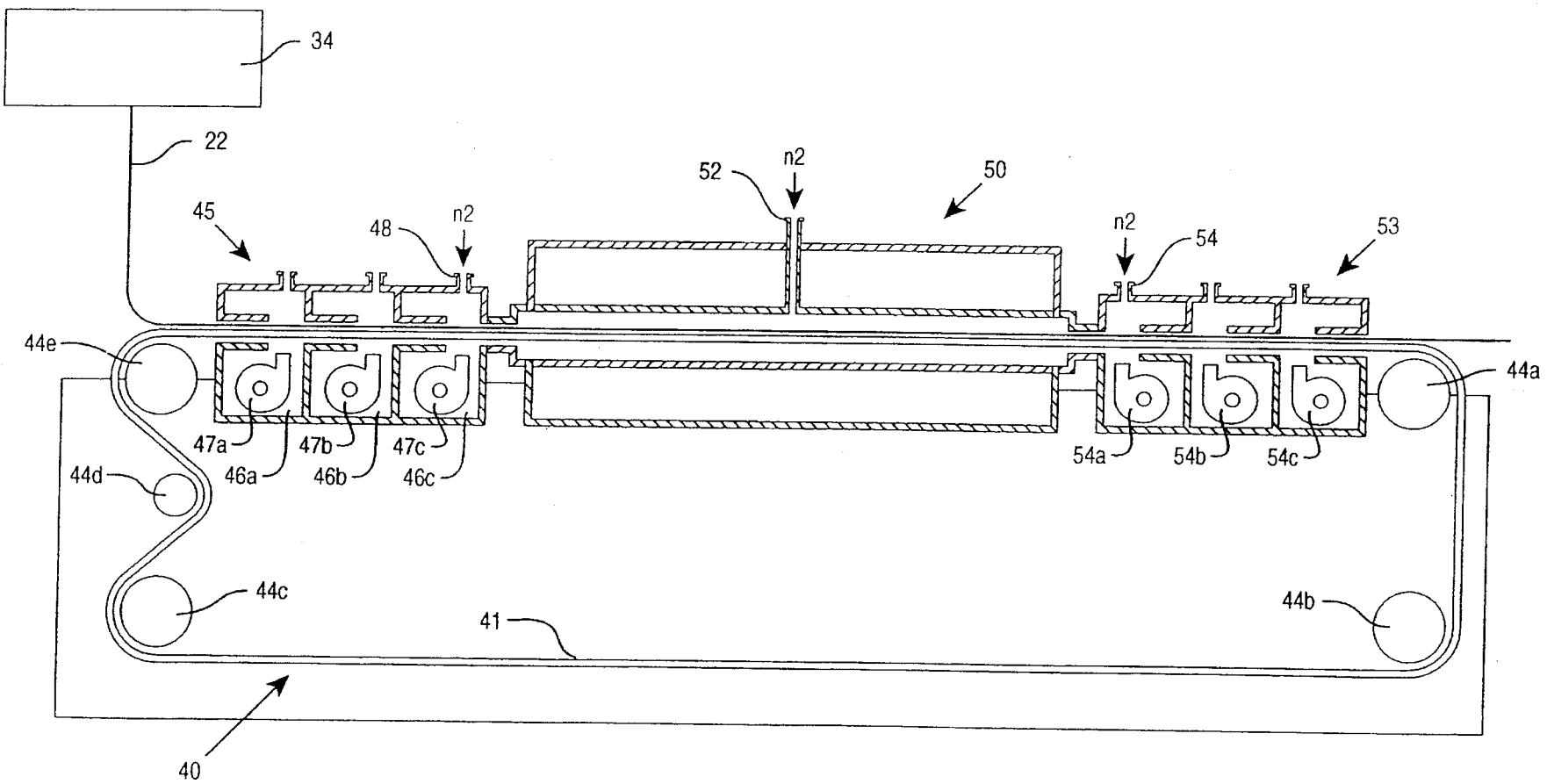
FIG. 9 is a greatly simplified side elevational view of an apparatus for heat treating the crimped polymeric precursor fibers to manufacture the heat set carbonaceous fibers of the invention.

FIG. 9 illustrates one form of an apparatus in which the crimped tow 22 can be treated so as to provide an improvement in tenacity over prior non-linear carbonaceous fibers. As shown, the temporary crimped tow 22 is delivered from the crimping gears (not shown here) or a crimped tow supply container 34 onto a conveyor 40 having a movable belt 41 which is trained around wheels 44*a*, 44*b*, 44*c*, 44*d*, and 44*e*, one of which is driven at a constant speed by a motor or other drive mechanism, not shown. After the crimped tow 22 is placed on the conveyor belt 41, it is transported through an airlock 45 without imparting any stress or tension on the tow 22. The airlock 45 comprises a plurality of chambers 46*a*, 46*b*, 46*c* each of which contains a fan or blower 47*a*, 47*b*, 47*c* for delivering a dynamic flow of an inert gas such as nitrogen from a source (not shown) to the tow 22 to remove any entrained oxygen from the fiber tow. The fans 47*a*, 47*b*, 47*c* can be arranged in a closed circuit to recycle nitrogen through the chambers. The airlock 45 is provided with at least one inlet 48 through which nitrogen is added to maintain an inert atmosphere in the chambers 46*a*, 46*b*, 46*c*. After passage through airlock 45 the tow 22 enters a housing or enclosure 50 which can consist of one or more heating chambers 51 (only one being shown). The airlock 45 prevents ingress of air, i.e oxygen, into the heating chamber 51 while an inert atmosphere is maintained within the chamber 51 by delivery of the inert gas through an inlet 52. The conditions in the chamber 51 are such as described in U.S. Pat. No. 4,837,076 to provide the fibers or tow 22 with the desired degree of carbonization and to impart a substantially permanent heat set to the crimped fibers.

The tow 22 which is substantially permanently heat set is then passed through an airlock 53 which passes a cooling inert gas through the tow 22 prior to it being carried out a to container or to be taken up on a roll, not shown. Airlock 53 contains at least one nozzle 54 through which an inert gas can enter and a plurality of fans or blowers 54*a*, 54*b*, 54*c* for delivering a dynamic flow of inert gas through the tow 22 to cool the tow 22 and to remove any by-product gases from the tow prior to entering the atmosphere to reduce any oxidative reactions.

The fibers are heat treated in an inert atmosphere such as, for example, nitrogen, argon, helium, hydrogen, carbon dioxide or mixtures thereof. The heating zone can be a single or multigradient temperature furnace comprising a number of heating zones that can be maintained at different temperatures.

Alternatively, the inert gas can be injected into at least one of the heating chambers of the housing so that it comes into intimate or forced contact with the tow of fibers. A dynamic flow of the inert gas can be provided by, for example, one or more jet nozzles (not shown) extending into the housing 50 at predetermined positions. The jet nozzles can extend either in an upward or downward direction to provide for a forced flow of the inert gas through the fiber tow, rather than merely providing a static inert atmosphere in the housing, as is conventionally performed. Any interstitial oxygen or off-gases which are produced during heating of the polymeric precursor fiber tow are forcefully driven from the fibers, thereby improving the physical characteristics of the fibers. By this procedure the occurrence of side reactions of the polymeric fiber material are believed to be avoided, thereby producing a fiber with improved tenacity.

The inert gas is applied to the tow of fibers passing through the airlocks 45, 53 at a rate of from about 1.3 to about 39 $ft^3$/min. (37 to 1104 l/min), preferably from about 10 to about 15 $ft^3$/min. (283 to 425 l/min). The inert gas is applied so that, preferably, it passes over and between the fibers or fiber tow in a transverse flow direction or at an acute angle with respect to the movement of the conveyor belt and at a rate sufficient to remove interstitial oxygen or off gases from the housing. It will be appreciated, that the gas can also flow in a direction coincident with the direction of movement of the fiber or fiber tow as long as the gas flow is sufficiently dynamic to contact the fibers and to carry away any off gases that are generated during heating of the fibers. The heating chamber 51 is provided with an exhaust opening (not shown) for exhaust of the inert gas from the chamber(s). If desired, the gas can be recirculated through a conduit (not shown) connected to the exhaust opening and to a suitable place on the housing for recirculation into the heating chamber.

If the inert gas becomes depleted with off gases from the fibers or fiber tow, it can be discharged or combined with fresh inert gas. The velocity of the gas should be controlled since, at the higher rates of flow, the turbulence that can be created by the inert gas flow can cause an excessive movement of the fibers as it passes through the fiber tow and the housing. Such excessive movement can place a stress on the fiber or stretch the fiber sufficiently to reduce or eliminate the temporary crimp in the fiber.

The residence time of the fibers or fiber tow in the heating zone is dependent upon the particular polymeric material of the fibers utilized, the diameter of the fibers or the diameter or thickness of the fiber tow, the degree of carbonization desired, and the temperature(s) utilized.

Accordingly, by providing a dynamic flow of an inert gas directed against the fibers to remove intersticial oxygen, the fibers thus produced exhibit a greater tenacity and elongation to break without any substantial loss in elongatability. The fiber treatment with a dynamic flow of an inert gas has not been disclosed in prior art manufacture of linear or non-linear polymeric fibers.

With the crimping mechanism of the invention, it is now possible to use extremely large tows of more than 40,000 individual fibers. Tows having more than 300,000 fibers, for example, when arranged in a flat sheet like pattern can be passed through the fine crimping mechanism 30 and, optionally, through the crimping wheel to provide the tow with a dual crimp. The crimping gears 30 and crimping wheel can be made to a width sufficient to accommodate a flat tow of any desired width and thickness provided that the teeth of the crimping gears are spaced from each other a distance sufficient to provide the fibers in the tow passing through the crimping gears with a crimp having a reversible deflection ratio of greater than 1:1 but less than 1.2:1 and without damaging the fibers. For example, a 320 K tow, such as is commercially available from Courtaulds Ltd. U.K. has an average width of about 4 to 5 in. (10 to 12.5 cm) and an average thickness of about 15 to 30 fibers in thickness (about 40 mil—before crimping).

A particular advantage of the flat tow is realized when the tow is passed through the airlocks and/or heating chambers and subjected to a dynamic flow of the inert gas. The volume and velocity of the gas is easily adjusted to flow past each of the fibers and sweep the fibers of intersticial oxygen and any gases generated during the carbonization process. Since the fibers are spread out over a greater width than the fibers in a tow having a generally circular cross section, the inert gas does not encounter as great a resistance to flow past each individual fiber thereby providing for a more efficient sweeping of the inert gas through the fiber tow to improve the physical characteristics of the fibers.

The non-graphitic carbonaceous fibers of the invention in a blend with synthetic polymeric fibers or natural fiber are useful for the preparation of fiber structures such as, for example, tufted or woven covering for furniture, carpets, wall coverings, fabrics of fine yarn, and the like, all of which exhibit a substantially increased ignition resistance as compared to non-carbonaceous fibers.

Polymeric precursor materials such as stabilized acrylic filaments which are advantageously utilized in preparing the carbonaceous fibers of the invention are selected from one or more of the following: acrylonitrile based homopolymers, acrylonitrile based copolymers and acrylonitrile based terpolymers. The copolymers preferably contain at least about 85 mole percent of acrylonitrile units and up to 15 mole percent of one or more monovinyl units.

Examples of vinyl monomers copolymerizable with acrylonitrile include methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; and vinylsulfonic acid and the salts thereof.

The preferred precursor materials are typically prepared by melt spinning, dry or wet spinning the precursor material in a known manner to yield a monofilament or multifiber tow. The fiber or tow are stabilized and then heated to a temperature and for a period of time as described in U.S. Pat. No. 4,837,076, or as modified in the present invention.

The polyacrylonitrile (PAN) based precursor fibers which have a nominal diameter of from 4 to 25 micrometers are collected as an assembly of a multiplicity of continuous filaments in tows. The fibers are then stabilized, for example by oxidation, or any other conventional method of stabilization. These stabilized fibers typically have an elongatability of from about 22 to about 29%. The stabilized fibers are crimped and thereafter heat treated according to the process of the present invention, in a relaxed and unstressed condition, at elevated temperatures, in an inert, non-oxidizing atmosphere for a period of time to produce a heat induced thermoset reaction and thereby producing a carbonaceous fiber or tow. A nitrogen content of from about 5 to about 35% is maintained in the fiber when a non-graphitic fiber is desired.

It is to be understood that the fibers can be initially heat treated at a higher temperature for a time period depending on the degree of carbonization desired so long as the heat treatment is conducted while the fibers are in a relaxed or unstressed condition and under an inert, nonoxidizing atmosphere which may include a reduced pressure atmosphere. Preferably, the stabilized polymeric precursor fibers are also prepared without the application of stress or strain.

As a result of the higher temperature treatment of 525° C. and above, a substantially permanent or irreversible heat set is imparted to the fiber or tow.

Stabilized polymeric precursor fibers can also be prepared from other well known materials such as polyacetylene, polyphenylene, polyvinylidene chloride, aromatic polyamides (KEVLAR®, a trademark of E. I. du Pont de Nemours & Co.), polybenzimide resin, SARAN® (trademark of The Dow Chemical Company), and the like.

It is understood that aromatic polyamide fibers, when heat treated at an elevated temperature for a period of time, are provided with an increase in carbon content, that is, the aromatic polyamide fibers are partially carbonized as disclosed in U.S. Pat. No. 4,642,664. Specific examples of aromatic polyamides include polyparabenzamide and polyparaphenylene terephthalamide. Other wholly aromatic polyamides are poly(2,7-paraphenylene-2- poly(methyl-1,4-phenylene) terephthalamide.

The aromatic polyamide fibers, that is, the aramid fibers of the invention are provided with a substantially heat set nonlinear configuration when heated in a crimped and nonstressed condition at a temperature above 200° C., preferably at a temperature of from 200° C. to 375° C. in a water free atmosphere. The period of time employed in heating the fibers depends on the temperature, size of fiber, type of aromatic polyamide, etc. A more permanent heat set is imparted when the fibers are heated at higher temperatures rendering the fiber more carbonaceous.

Stabilized or nonstabilized aromatic polyamide fibers which are provided with a non-linear configuration when heat treated in a crimped and unstressed condition and in an inert atmosphere, result in a stronger fiber with a more permanent crimp than the same fibers when heat treated in air.

The crimped carbonaceous acrylonitrile based fibers which are prepared according to this invention can be classified into four groups.

In a first group, the carbonaceous fibers have a carbon content of greater than 65% and are electrically nonconductive and possess no antistatic characteristics, i.e., they are not able to dissipate an electrostatic charge. When the fibers are stabilized and heat set acrylic fibers, it has been found that a nitrogen content of about 18% or higher results in electrically nonconductive fibers.

In a second group, the carbonaceous fibers are classified as being partially electrically conductive (i.e., the fibers have a relatively low electrical conductivity), have static dissipating characteristics, and have a carbon content of greater than 65%. When the fibers are stabilized and heat set acrylic fibers, it has been found that the nitrogen content is from about 14 to about 18%. The preferred fibers of this group have an elongatability to break of from about 3 to about 6 percent. These fibers have a specific resistivity of greater than $10^{-1}$ ohm-cm.

In a third group are fibers having a carbon content of at least 85% but less than 92% and a nitrogen content of at least 5%. These fibers are characterized as having a high electroconductivity and a specific resistivity of less than $10^{-1}$ ohm-cm.

In a fourth group of fibers are graphitic fibers which have an elemental carbon content of at least 98%, and which have characteristics which are further defined in U.S. Pat. No. 4,005,183 to Singer. These fibers can be incorporated into various thermoplastics materials to lower their surface and volume resistivities so that they can dissipate electrostatic charges and attenuate electromagnetic signals (EMI shielding).

It will be appreciated that the tenacity and elongatability of a fiber or fiber tow depends, to a large extent, on the heat treatment of the fiber. Thus, fibers that are treated at lower temperatures, such as the fibers of groups 1 and 2, exhibit a superior elongatability. Fibers that are treated at the higher range of temperatures, such as the fibers of groups 3 and 4 exhibit less elongatability. Graphitic fibers are inherently brittle and exhibit even less elongatability, but still represent a valuable and useful product that has many applications in industry.

The nongraphitic carbonaceous fibers of this invention, preferably those of groups 1 and 2, can be used in substantially any desired fabricated form. The carbonaceous fibers can be stretch broken and formed by conventional equipment into roving, cord, rope or spun yarn. The spun yarn can be manufactured into woven or knitted cloth, carpets, blankets, and the like. Nonwoven structures can be manufactured into a wool like fluff or batting, sheeting, panel, paper, and the like. A wool like fluff or batting is particularly useful as a thermal insulating material.

In accordance with another embodiment of the invention, the carbonaceous fibers can be blended with polymeric fibers, i.e., either synthetic or natural fibers or both, to form a fiber mixture or blend that may find particular use as a stuffing for sleeping bags, pillow, etc.

The blend of carbonaceous fibers and other polymeric fibers may be formed into a carded web employing conventional carding equipment which is well known to persons skilled in the art. The carding operation serves to uniformly blend the carbonaceous fibers and other staple fibers. The carded web will ordinarily have a thickness in the range of up to about 2 to 5 cm but can be built up into multiple plies or layers to produce a web having a thickness of 25 cm or more depending upon the desired end use of the material.

Blended fibers can also be formed into yarns using any one of the conventional systems, such as the ring and rotor system, air jet or twist systems. These yarns may be further combined with the spun/staple cotton system, wool or worsted flax system to make plied, wrap, core spun or multiple yarns where the surface fibers are predominantly non-linear carbonaceous fibers. Such yarns are more advantageous than yarns which have been topically treated with flame retardant materials that can be laundered away.

Blends of fibers can be utilized to form yarns and fabrics having fire retarding characteristics. For example, a blend of fibers which contains from as little as 7.5 to 20 percent of the carbonaceous fibers of the invention can be utilized to manufacture fire retardant articles such as clothing, blankets, sheets and the like. Such fabric articles have excellent washability and shape retaining quality especially when a large proportion of nonlinear carbonaceous fibers are employed. Carbonaceous fibers having a nitrogen content from about 16 to 20 percent are especially useful for fabrics making skin contact with the wearer.

Fabric structures which contain the carbonaceous fibers of the invention in amounts of about 20 to 40 percent have greater flame retardancy and can advantageously be used for seat coverings, upholstery, battings, curtains, etc. Providing carbonaceous fibers near the surface of an article provides the article with a flame barrier.

Use of carbonaceous fibers in amounts of up to 92.5 percent in blends with other fibers improve the fire blocking and fire shielding characteristics of the structures. Structures having greater amounts of carbonaceous fibers also have greater chemical resistance. Such structures can be used as filters, hose coverings, static precipitators, camouflage, fire shields, panels for ships, etc.

Non-woven, non-flammable structures, such as webbings, can be made by conventional methods of utilizing a blend of carbonaceous fibers with other synthetic or natural fibers and a suitable binder such as polyester, polypropylene or the like, in an amount for example up to 25% and subjecting the blend to heat and/or pressure.

Natural fibers include, for example, cotton, wool, wood, flax, silk, and mixtures thereof.

Examples of other fibers that can be used include linear and nonlinear fibers selected from natural or polymeric fibers, other carbon fibers, ceramic fibers, glass fibers, or metal or metal coated fibers. In particular, natural and/or synthetic polymeric fibers that are well adapted to be included into blends with the carbonaceous fibers of the invention are cotton, wool, polyester, polyolefin, acrylic, nylon, rayon, tetrafluoroethylene, polyamide, vinyl, and protein fibers. Other fibers that can be blended with the carbonaceous fibers of the invention include mineral fibers such as, for example, silica, silica alumina, potassium titanate, silicon carbide, silicon nitride, boron nitride, boron, and oxide fibers derived from boron, thoria or zirconia.

To provide improved ignition and oxidation resistance the carbonaceous fibers of the invention can be treated with an organosilicone polymer as disclosed in U.S. Pat. No. 5,024,877. The organosilicone polymer when used in an amount of from 0.5 to about 20%, preferably about 10% by weight, protects the carbonaceous fibers while maintaining the favorable characteristics of the fibers. The organosilicone polymer is characterized by having the following recurring units:

$$(Si—O—Si—O)_n$$

In accordance with another embodiment, the invention is directed to a composite which comprises a synthetic resin, such as a thermoplastic or thermosetting resin, that is compressed together with a batting of the aforementioned carbonaceous fibers. Prior to compression, the batting can be treated with an organosilicone polymer in an amount to provide additional ignition resistance. The composite can be useful in forming fire resistant or flame shielding structural panels for use in vehicles, particularly airplanes, ships, building structures, etc.

Advantageously, the composite of the present invention contains from 10 to about 90% by weight of carbonaceous fibers preferably from 20 to about 75% by weight of the composite. The synthetic resin used in the composites of the present invention can be selected from any of the conventional type resin materials such as thermoplastic resins and thermosetting resins.

Thermoplastic resins, for example, can include polyethylene, ethylenevinyl acetate copolymers, polypropylene, polystyrene, polyvinyl chloride, polyvinyl acetate, polymethacrylate, acrylonitrile-butadiene-styrene copolymers (ABS), polyphenylene oxide (PPO), modified PPO, polycarbonate, polyacetal, polyamide, polysulfone, polyether sulfone, polyolefins, polyacrylonitrile, polyvinylidene chloride, polyvinyl acetate, polyvinyl alcohol, polyvinyl pyrolidone, ethyl cellulose, polyvinyl chlorodivinyl acetate copolymer, polyacrylonitrile-styrene copolymer, polyacrylonitrile-vinyl chloride copolymer, carboxymethylcellulose, polyparaxylene, polyimide, polyamideimide, polyester imide, polybenzimidazole, polyoxadiazole, and the like.

Thermosetting resin, for example, can include phenolic resins, polysiloxanes, urea resin, melamine resin, alkyl resin, vinyl ester resins, polyester resin, xylene resins, furanic resins, and the like. The thermosetting resins also include the organosilicones used to provide the improved fire resistant effect.

Other suitable resinous materials are disclosed in Modern Encyclopedia, 1984–85, Vol. 61, No. 10A, McGraw-Hill, New York, N.Y.

The composite provides a structure which is particularly useful as a fireblocking structural panel for the interior of airplanes. The structural panel is formed from a polymeric matrix having from 20% to about 50% by weight of nonlinear carbonaceous fibers incorporated therein. The panel is formed by the application of heat and pressure and can be provided with a polymeric film, preferably a MYLAR film on an outer surface thereof. The film advantageously can be provided with a decorative design or embossment. The opposite side of the panel can be provided with a reinforcement scrim which can be in the form of a screen, grate, or web of the carbonaceous fibers. The screen can also be made of metal, i.e. nickel or steel, Pyrex glass, an organosilicone polymer composite containing unidirectional fibers, and the like.

A preferred polymer for forming airplane panels can be, for example, the polyester fibers sold by Eastman Chemical Products under the trademark KODEL 410, 411, 432 and 435, and DACRON 262 and 124W of E. I. du Pont de Nemours.

In accordance with a further embodiment of the present invention, a ceramic and/or metallic coating can be formed on a carbonaceous fiber or fiber structure, i.e., a tow, matting, batting, yarn or fabric. The coated carbonaceous fiber structure can be used in an oxidizing environment and in high temperature applications where uncoated carbonaceous fiber structures could otherwise not be used satisfactorily.

Ceramic materials can also be utilized in the present invention such as the oxides or mixtures of oxides, of one or more of the following elements: magnesium, calcium, strontium, barium, aluminum, scandium, yttrium, the lanthanides, the actinides, gallium, indium, thallium, silicon, titanium, zirconium, hafnium, thorium, germanium, tin, lead, vanadium, niobium, tantalum, chromium, molybdenum, tungsten, and uranium. Compounds such as the carbides, borides and silicates of the transition metals can also be used. Other suitable ceramic materials which can be used are zircon-mullite, mullire, alpha alumina, sillimanite, magnesium silicates, zircon, petalire, spodumene, cordierite and aluminosilicates. Suitable proprietary products are "MATTECEL" (Trade Name) supplied by Matthey Bishop, Inc., "TORVEX" (Registered Trademark) sold by E. I. du Pont de Nemours & Co., "WI" (Trade Name) sold by Corning Glass and "THERMACOMB" (Registered Trademark) sold by the American Lava Corporation.

Other suitable active refractory metal oxides include for example, active or calcined beryllia, baria, alumina, titania, hafnia, thoria, zirconia, magnesia or silica, and combination of metal oxides such as boria-alumina or silica-alumina. Preferably the active refractory oxide or metal is composed predominantly of metals or oxides of one or more metals of Groups of II, III and IV of the Periodic Table.

Among the preferred compounds can be mentioned YC, $TiB_2$, $HfB_2$, $VB_2$, VC, VN, $NbB_2$, NbN, $TAB_2$, $CrB_2$, $MOB_2$, and $W_2B$.

Preferably, the coating formed on the surface of the carbonaceous fibers or fiber structures of the present invention are selected from oxides such as $TiO_2$; nitrides such as BN; carbides such as BC and TiC; borides such as $TiB_2$ and TiB; metals for example Ni, Au, and Ti; and the like.

Any conventional method of forming the coating on the carbonaceous fiber or fiber structure of the invention can be used. For example, chemical vapor deposition or dipping into a coating solution are satisfactory. Brushing or spraying a coating solution on the fibrous carbonaceous fiber can also be used.

The thickness and amount of coating applied to the carbonaceous fiber or structure should be sufficient such that the surface coating substantially insulates the carbonaceous fiber from the oxygen-containing atmosphere, i.e., such that the coating exposed to the oxygen-containing atmosphere protects the carbonaceous fiber from oxidation. The thickness and amount of coating will depend on the form in which the fiber or fiber structure is used and the desired application. For example, the coating thickness will depend on whether the fiber structure is a singly ply which can have a coating thickness of about 1 micron or a batting which can have a coating thickness of about 10–100 microns.

Exemplary of the present invention are the following examples:

EXAMPLE 1

A 40 K tow (40,000 individual fibers) of oxidized polyacrylonitrile based precursor fibers, sold under the Tradename PANOX by R. K. Textile Ltd., of Heaton-Noris, Stockport, England, and having a density of from 1.35 to 1.39 g/cc and containing at least 85 mole percent acrylonitrile units, is passed through a constant indexing fine crimp forming device to provide the tow with approximately 12 crimps per inch (5 crimps per cm). The crimp forming device comprises, as one component, a pair of floating, non-contacting crimping gears with rounded teeth (there being no sharp edges on the teeth) which form the crimp. Each crimping gear has a diameter of 2 in. (5 cm) and is provided with 96 rounded teeth. As another gear component an antibacklash mechanism is provided which drives each of the crimping gears in constant synchronization and which allows for a gap between the opposing teeth of the crimping gears of approximately the thickness of the tow. The gap can be adjusted to provide sufficient pressure on the fiber tow without causing any damage to the fibers during the crimping process. The antibacklash mechanism transfers the torque and compensates for the variable spacing of the gears.

The crimped tow is passed onto a conveyer, without applying any stress or strain on the fibers in the crimped tow, and then through a heated furnace maintained at a temperature of 650° C. The furnace is constantly purged with nitrogen in accordance with the procedure described in U.S. Pat. No. 4,857,394. The residence time in the furnace is 1.5 minutes. A tow of partially carbonized fibers is produced having no sharp V-shaped bends or kinks. The fibers have an elongation to break of 5.4%, a pseudoelongation of 1.5%, a reversible deflection ratio of from 1.07 and a tenacity of 5 g/d.

The fibers are useful to prepare yarn or an insulation in the form of a wool like fluff, batting, and the like.

EXAMPLE 2

A 320 K tow of SAF (Special Acrylic Fiber) manufactured by Courtaulds Ltd., U.K, was oxidatively stabilized at a temperature of from 250° C. to about 300° C. in air to form oxidized polyacrylonitrile fibers (OPF) having a density of from 1.36 to 1.37 g/cc. The fibers were converted to nonlinear fibers utilizing the crimping apparatus described in example 1 and illustrated in FIG. 8. The crimped tow of fibers was then passed through a heating system as described in example 1 at a temperature of from 625° C. to about 650° C. for about 1.5 to 2 minutes. The heating system was provided with a constant supply of nitrogen during passage of the fiber tow through the heating system. The resultant permanently heat set nonlinear fibers in the tow had a reversible deflection ratio of 1.16:1, a pseudoelongatability of 11%, an elongation to break of 5%, a tenacity of from 6 to 10 g/dn, a nitrogen content of 16%, an oxygen content of 4% and a carbon content of 76%.

The fibers of the tow are suitable for blending with other synthetic or natural fibers to form an ignition resistant yarn.

EXAMPLE 3

The procedure of Example 1 is repeated except that the furnace is modified, as illustrated in FIG. 9, so that nitrogen gas can dynamically flow through the tow and out of the chamber. The nitrogen flows, at a relatively high flow rate, through nozzles into the furnace at a flow rate of 13 $ft^3$/min. (368 l/min), and flows directly onto the tow and over the individual fibers as it passes over an outlet opening for the removal of the nitrogen and spent gases.

The fibers of the resulting tow have an elongation to break of 3.5%, a pseudo elongation of 10%, a reversible deflection ratio of from 1.13 to about 1.14, and a tenacity of 19 g/d. This experiment illustrates that the application of a dynamic flow of the inert gas through the fiber tow is effective to sweep away gases from the fibers that are produced during the heat treatment (condensation) of the fibers while passing through the furnace, resulting in a fiber with a substantial increase in tenacity.

EXAMPLE 4

Runs are made in a Lindberg Tube Furnace to convert gear crimped oxidized polyacrylonitrile fibers (OPF) to non-linear carbonaceous fibers with the use of a dynamic flow of nitrogen through the fibers. Samples of OPF having a density of from 1.35 to 1.38 g/cc and having 6000 filaments per tow (6 K) are crimped by first moistening the OPF and then heating to a temperature of from 90° C. to 100° C. just prior to passing the fiber tow through the crimping mechanism described in example 1. The crimped OPF tow is placed into a quartz boat. The boat and fibers are then placed inside a $N_2$ purged quartz tube and allowed to purge for 15 minutes to remove all air from the tube and fibers. The boat with the fibers is then moved into a heating zone in the furnace and held at a temperature of from 550° C. to 600° C. for a period of time of from 1.5 to 2 minutes. The boat and fibers is then removed from the heating zone of the furnace and the permanently heat set, non-linear carbonaceous fibers are allowed to cool to a temperature below 100° C. while under a $N_2$ purge. The fibers had an elongation to break of 6%, a pseudoelongation of 5%, a reversible deflection ratio of about 1.11:1 and a tenacity of 3.5 g/d.

A portion of the sample is blended with 50% polyester staple using a roller top card. Small amounts of fine spun yarn are also made. The samples readily passed the vertical burn test and the various fire blocking tests as listed in FAR 25.853. The fibers can be used to prepare fire resistant garments, carpets and furniture coverings.

EXAMPLE 5

The procedure described in Example 3 is repeated except that the fibers are provided with a complex crimp in accordance with a further embodiment of the invention as illustrated in FIG. 3 in which the crimped fibers are passed through a second set of driven crimping wheels, application Ser. No. 08/098,658 filed Jul. 2, 1993, to provide the fibers with a larger wave or crimp with a higher amplitude (2 crimps per inch) and a lower frequency over the fine crimp having a higher frequency without pulling out or obliterating the higher frequency crimps. The complex crimped fibers are deposited upon a moving conveyor belt, without applying stress or tension on the crimped fibers, and are then passed into a heating zone in a furnace and held at a temperature of from 550° C. to 600° C. for a period of time of from 1.5 to 2 minutes. During passage of the fibers through the heating zone, a constant flow of $N_2$ gas is passed through the fibers. The fibers are then removed from the heating zone of the furnace and the heat treated, permanently set, fibers are allowed to cool to a temperature below 100° C. while under a $N_2$ purge. The fibers exhibited a reversible deflection ratio of 1.19:1 an irreversibly heat set complex crimp having an elongation to break of 5%, an tenacity of 2.5 g/d, a pseudoelongation of 14% and a average fiber diameter of 7.0 to 7.4 microns.

A batting having a thickness of 3.5 in. and a density of about 0.2 lbs/ft$^3$ (3.2 kg/m$^3$), containing 85% carbonaceous fibers of this example and 15% polyester binder fibers has a R value of 19 to 21.

EXAMPLE 6

A. A sample of a 6 K tow of non-linear carbonaceous fibers prepared by a knit-deknit procedure in accordance with the process of U.S. Pat. No. 4,837,076 in which the fibers exhibit a reversible deflection ratio of greater than 1.2:1, had been heat treated to a temperature of about 550° C. for one minute. The fibers have a pseudoelongatability of about 30%, an elongation to break of about 4% and a tenacity of 2.5 g/d. Staple fibers having an average length of 2.5 in. (6.35 cm) are passed through a roller and clearer card apparatus (sold by Davis & Ferber) to open the fibers to form a wool like fluff.

B. A sample of a tow of a 6 K tow of fine crimped fibers of the invention having 9 crimps per inch (3.5 crimps/cm) is prepared and heat treated at a temperature of about 550° C., under the same conditions as in part A. The fibers have a reversible deflection ratio of 1.14:1, a pseudoelongatability of about 10%, an elongation to break of about 4%, and a tenacity of about 3.5 g/d.

C. A sample of a tow of a 6 K tow of fine crimped fibers of the invention having 9 crimps per inch (3.5 crimps/cm) is prepared and heat treated at a temperature of about 550° C., under the same conditions as in Example 3 in which the fibers are subjected to a dynamic flow of gas. The fibers have a reversible deflection ratio of 1.15:1, a pseudoelongatability of about 10%, an elongation to break of 5%, and a tenacity of 12 g/d.

The fibers of sample (A), as a result of poor cohesiveness had more fly and fall out than samples (B) and (C).

D. Hand slivers (a continuous strand of loosely assembled fibers without twist) of 0.3 g/in (11.8 g/m) are prepared from each of the samples A, B and C and are mounted on a 1225 Instron having a gauge length to 3 inches (10.6 cm). Using a process speed of 2 mm/min. and a 20 g load cell, each sliver is measured to determine the force to pull apart a web which would have been produced if it comes off a card doffer having similar fibers so as to determine their cohesiveness.

| Results | | |
|---|---|---|
| Sample A | Sample B | Sample C |
| 3.8 g | 11.8 g | 12.1 g |

The fibers of samples B and C have approximately three times the cohesive force of sample A because of the improved fiber-fiber interlocking of the fine crimp present in these samples.

EXAMPLE 7

Samples of the PAN fibers of Examples 1 and 4 are blended with a 60% KODEL 435, a polyester staple fiber, on a randomizing card. The blended fibers are then placed in a Rando B apparatus for forming a 4 oz. per square yard (135 g/m$^2$) non-woven batting. The resulting batting was tested for fire resistant characteristics and passed the vertical burn test according to (Federal Test Method) FTM-5903 and (Federal Aviation Regulations) FAR25.853b.

EXAMPLE 8

A 1500 denier 6 K tow of stabilized p-aramid fibers was crimped following the procedure of Example 3 without a dynamic flow of nitrogen and heated to a temperature of 275° C., under a nitrogen purge. The heat treatment was conducted over a period of 10 minutes. When cooled, the tow was opened. The fibers contained 12 heat set crimps/in. (2.54 cm) which could not be removed by stretching the fibers or by heating the fibers with a conventional hair dryer.

The fibers have a reversible deflection ratio of about 1.15:1 and a pseudoelongatability of about 8%.

COMPARATIVE EXAMPLE 9

Carbonaceous fibers produced by the knit/deknit process and heat treated at a temperature of about 625° C. having a length of 2 in. (5 cm) and a reversible deflection ratio of 1.3:1 were first preopened in a Carolina Machine Company preopener. The preopened fibers were further opened by carding them on a Hollingsworth modified roller and clearer card. The carded fibers showed more than usual breakage and could not be collected in a sliver form which is essential for further processing to convert the fibers into a yarn. Consequently, the carded fibers were collected in bulk form and then blended with preopened Dacron polyester fibers of 1.6 denier and 1 to 5 inch length (2.5 to 12.7 cm) (DuPont Type 90A). A 50/50 blend of the carbonaceous and polyester fibers was then carded in a Hollingsworth carding machine to produce a 60 grain per yard (3.9 g/yd) sliver. Eight such slivers were then combined on a Platt Saco Lowell Roller Draw Frame. Each sliver fell apart during drafting because of poor cohesiveness.

EXAMPLE 9

In another experiment, a tow of the fine crimped carbonaceous fibers of the invention having a reversible deflection ratio of 1.15:1, and a length of about 2 inches (about 5 cm) were preopened in a manner similar to that described in Comparative Example 9 and blended with Dacron™ fibers of Type 90A, 1–6*d*, a polyester fiber manufactured by DuPont having lengths from 1 to 5 in. (5 to 25 cm). The preopened carbonaceous fibers were then carded and collected in sliver form. The slivers had a weight of 60 grains per yard (4.3 g/m).

In one experiment, four slivers of the fine crimped carbonaceous fibers were combined with four slivers of 60 grains per yard of Dacron Polyester fibers on a Platt Saco Lowell Roller breaker draw frame to produce a 50/50 blend of the fine crimp carbonaceous fibers and the 60 grain polyester fibers. The slivers from the breaker draw frame were then combined in a finisher Platt Saco Lowell Draw Frame to produce a 60 grain per yard blended sliver. The blended sliver was then processed in a Platt Saco Lowell Rovomatic Roving frame to produce a one hank roving (840 yards of roving weighing one pound equals one hank). The single roving was then spun into a $24^s$ cotton count yarn on the SKF Spintester Ring Frame at a spindle speed of 15,000 rpm and a twist factor of 3.5 to produce a yarn with a twist of 17 turns per inch (6.7 turns/cm).

This yarn had a break factor of 2800 which is comparable to any cotton and polyester blended yarn produced by this process. The success of making a yarn is only possible because of the nature of the fine crimp in the carbonaceous fiber of the invention.

EXAMPLE 10

In another experiment, the preopened and carded fine crimped fibers of the invention having a reversible deflection ratio of 1.16:1 were blended with preopened polyester fibers as in the example above to produce a 50/50 blend by weight. The blend was then carded on a Hollingsworth modified roller and clearer top card to produce an intimate blended 60 grain per yard sliver. The slivers were then combined and processed in a breaker drawing and finisher drawing in a manner similar to that described in Example 9. The yarn produced had comparable strength to that produced by sliver blending because of the cohesiveness of the fibers.

EXAMPLE 11

In another experiment blended carded (intimate blend) and sliver blended fine crimped fibers of the invention having a reversible deflection ratio of 1.16:1 and polyester fibers having a weight of 50 grain slivers were processed on a Toyoda Rotor Spinning Frame. The rotor has a diameter of 35 mm and the rotor speed used was 40,000 rpm. The draft and take up speed on the rotor frame was adjusted. A fine blended yarn was produced.

EXAMPLE 12

In this experiment, the blended yarn of Example 9 was knitted on a Lawson Hamphill Fiber Analyzer knitting machine to produce a jersey knit sock. A 22 gauge cylinder was used to produce a 20 course/inch and 15 wales/inch fabric.

EXAMPLE 13

A. Battings were made by blending the same percentage as in Example 9 of each respective opened fiber in a blender/feed section of a sample size 30 cm Rando Webber Model B (manufactured by Rando Machine Corp. of Macedon, N.Y.). The fibers had a reversible deflection ratio of about 1.15:1 and a pseudoelongatability of about 8%. The battings thus produced typically were about 2.5 cm thick. Samples were produced having bulk densities of 6.4 and 96 $kg/m^3$ respectively. The battings were thermally bonded by passing on a conveyor belt through a thermal bonding oven at a temperature of about 300° C.

B. To produce a flexible panel the batting of part A was sprayed with Dow Corning 1-2577 conformal coating (a hydrolyzed partial condensation of trimethoxy methyl silane) until 10% by weight of the coated batting was comprised of the conformal coating. The coated batting was compressed on a platen between two vinyl sheets at a pressure of 25 $lb/in^2$ and at a temperature of 260° F. (125° C.).

In lieu of the conformal coating, a silicone resin, which is polymerizable by either a heat condensation or a free radical condensation can be utilized.

The invention which is intended to be protected is not to be construed as limited to the particular embodiments disclosed herein since these are to be regarded as illustrative. Variations and changes which can readily be made by those skilled in the art without departing from the scope of invention are included herein.

What is claimed is:

1. A non-linear flame resistant nongraphitic carbonaceous fiber consisting of a fiber derived from a stabilized acrylic fiber, said carbonaceous fiber having a nitrogen content of at least 5% by weight, a carbon content of greater than 65% by weight, a pseudoelongatability of about 0.2 to 18%, a reversible deflection ratio equal to or less than 1.2:1.

2. The fiber of claim 1, having a tenacity of from about 2 to about 20 g/d.

3. The fiber of claim 1, having an elongatability of from about 2 to about 90%.

4. The fiber of claim 1, wherein said fiber has a crimp frequency of from 6 to 15 crimps per inch.

5. The fiber of claim 1, wherein said fiber has a bending strain value of less than 50%.

6. The fiber claim 1, wherein said stabilized acrylic precursor fiber is selected from the group consisting of acrylonitrile homopolymers, acrylonitrile copolymers and acrylonitrile terpolymers.

7. The fiber claim 1, wherein said copolymers and terpolymers contain at least 85 mole percent acrylic units and up to 15 mole percent of one or more monovinyl units.

8. The fiber of claim 1, wherein said carbonaceous fiber has a nitrogen content of from 18 to 22%.

9. The fiber of claim 1, wherein said carbonaceous fiber has a nitrogen content of from about 14 to about 18%, and wherein said fiber has a specific resistivity of greater than $10^{-1}$ ohm-cm.

10. The fiber of claim 1, wherein said carbonaceous fiber has a nitrogen content of about 5%, is electrically conductive.

* * * * *